US006688386B2

(12) United States Patent
Cornelssen et al.

(10) Patent No.: US 6,688,386 B2
(45) Date of Patent: Feb. 10, 2004

(54) TUBING HANGER AND ADAPTER ASSEMBLY

(75) Inventors: Michael James Cornelssen, Edmonton (CA); Keith David Farquharson, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 0 days.

(21) Appl. No.: 10/051,610

(22) Filed: Jan. 18, 2002

(65) Prior Publication Data

US 2003/0136556 A1 Jul. 24, 2003

(51) Int. Cl.[7] ..... E21B 33/04; E21B 33/03
(52) U.S. Cl. ..... 166/65.1; 166/97.5; 166/75.13
(58) Field of Search ..... 166/65.1, 89.2, 166/97.5, 368, 387, 95.1, 75.13, 242.2

(56) References Cited

U.S. PATENT DOCUMENTS

| | | | | | |
|---|---|---|---|---|---|
| 3,437,149 | A | * | 4/1969 | Cugini et al. | 166/379 |
| 4,154,302 | A | * | 5/1979 | Cugini | 166/378 |
| 4,260,022 | A | * | 4/1981 | Van Bilderbeek | 166/339 |
| 4,289,199 | A | * | 9/1981 | McGee | 166/65.1 |
| 4,600,054 | A | | 7/1986 | Miller et al. | 166/75.1 |
| 4,627,489 | A | * | 12/1986 | Reed | 166/65.1 |
| 4,708,201 | A | * | 11/1987 | Reed | 166/65.1 |
| 5,148,864 | A | * | 9/1992 | Willis et al. | 166/65.1 |
| 5,667,008 | A | * | 9/1997 | Moore | 166/65.1 |
| 5,732,771 | A | * | 3/1998 | Moore | 166/65.1 |
| 5,762,135 | A | * | 6/1998 | Moore | 166/65.1 |
| 5,795,169 | A | * | 8/1998 | Reed | 439/191 |
| 6,202,743 | B1 | * | 3/2001 | Moore | 166/65.1 |
| 2002/0070030 | | * | 6/2002 | Smith et al. | 166/379 |

FOREIGN PATENT DOCUMENTS

| | | |
|---|---|---|
| CA | 2327987 | 12/2000 |

* cited by examiner

*Primary Examiner*—David Bagnell
*Assistant Examiner*—T Shane Bomar
(74) *Attorney, Agent, or Firm*—Greenlee Winner and Sullivan, P.C.

(57) ABSTRACT

This invention provides a tubing hanger system which isolates production tubing from a power cable, protects the cable from high pressure, and enables pressure testing of the production and cable seals. A tubing hanger member is seated in a tubing head to seal against a central bore, and a tubing head adapter is fastened above the tubing head. The tubing head adapter and the tubing hanger member form a tubing port and a cable port. A tubing seal-off nipple connects and seals the tubing port in each of the tubing head adapter and the tubing hanger member, and a cable seal-off nipple connects and seals the cable port in each of the tubing head adapter and the tubing hanger member. Seals are provided between the cable and cable port in the tubing hanger member, and between the cable and cable port in the tubing head adapter.

14 Claims, 8 Drawing Sheets

TUBING HANGER AND ADAPTER ASSEMBLY

FIELD OF THE INVENTION

This invention provides a tubing hanger assembly for use in a tubing bead of a production well. The tubing hanger assembly provides for passage of production fluids from the production tubing mounted therebelow, through the tubing hanger assembly, while also providing isolation of the production tubing from an electrical power cable to pass through the tubing hanger assembly.

BACKGROUND OF THE INVENTION

Within a wellhead, the production string forms the primary conduit through which production fluids (liquids, gases, or any fluid produced from a wellbore) are produced to the surface. The production string is typically assembled with production tubing and completion components in a configuration that suits the wellbore conditions and the production method. An important function of the production string is to protect the primary wellbore tubulars, including the casing and liner, from corrosion or erosion by the production fluid. The production tubing is secured and supported in the wellhead by a tubing hanger which is a common component positioned inside a tubing head. It is common to use electric motor driven downhole pumps to augment the downhole pressure, with the electrical power cable routed from the downhole pump motor to the wellhead.

Canadian Patent Application No. 2,327,987, laid open on Jun. 8, 2001, to Robbins & Myers Energy Systems, L. P., discloses a wellhead for use in a subterranean well, including a tubing hanger with an electric power cable pack-off port that permits positioning of an electric submergible pump power cable through the port in the tubing hanger. The wellhead permits installation of packing and compression rings around the power cable to create a vapor-tight pressure seal around the outer cable jacket. The seal is stated to be rated at pressures of at least 750 psia. However, higher pressures might be encountered in a wellbore. Furthermore, this device does not enable testing of the integrity of the seals or protect the cable from a high pressure test of the production side.

U.S. Pat. No. 4,600,054, issued Jul. 15, 1986 to Miller et al., discloses a segmented tubing hanger to support tubing strings with the feature of allowing the sealed passage of electrical cable through the tubing hanger. However, the device requires that the tubing hanger section be moved to permit access to the seals for pressure testing, and does not enable re-energizing of the packing. An isolation system whereby the production tubing is kept separate from the electrical power cable is also lacking.

Presently, the prior art is thus lacking in that it is important that the tubing hanger incorporates certain features such as a sealing system to ensure that the production tubing is isolated from the electrical power cable. The tubing hanger should be designed such that pressure testing of the sealing system is easily accessible. Furthermore, protection of the electrical power cable from pressure testing in the tubing is desirable.

SUMMARY OF THE INVENTION

This invention provides a tubing hanger system which permits isolation and protection of the production tubing from the electrical power cable. Preferably, the system enables pressure testing of the integrity of both the production and cable seals, without requiring disassembly of the tubing hanger or any other components or damaging the electrical power cable, in advance of high pressure operations. Further, the tubing hanger system protects the cable from higher pressures encountered in the production tubing. The invention thus provides ease of pressure testing of the sealing means, and provides isolation of the electrical power cable from flange pressure testing.

Broadly stated, the invention provides a tubing hanger assembly for use in a tubing head of a production well, and which provides for passage of production fluids from the production tubing mounted therebelow, through a central bore in the tubing head and through the tubing hanger assembly, while also providing isolation of the production tubing from an electrical power cable which passes through the tubing hanger assembly. The tubing hanger assembly comprises:

- a generally cylindrical tubing hanger member adapted to seat in a landing seat in the tubing head, and to seal against the central bore;
- a tubing head adapter adapted to be fastened above the tubing head so as to enclose the tubing hanger member in a sealed relationship therebetween;
- the tubing head adapter and the tubing hanger member together forming two aligned, parallel spaced ports extending therethrough to provide a tubing port, which connects to the production tubing and permits passage of production fluids, and a cable port through which the electrical power cable extends;
- the tubing hanger member forming a seat in the cable port;
- a cylindrical tubing seal-off nipple adapted to connect and seal the tubing port in each of the tubing head adapter and the tubing hanger member;
- a cylindrical cable seal-off nipple adapted to seat against the seat in the cable port, and to connect and seal the cable port in each of the tubing head adapter and the tubing hanger member;
- a first seal below the cable seal-off nipple for sealing between the electrical power cable and the cable port in the tubing hanger member;
- a second seal above the cable seal-off nipple for sealing between the electrical power cable and the cable port in the tubing head adapter;
- whereby, the tubing seal-off nipple and the cable seal-off nipple when sealed in the tubing and cable ports, provide isolation of the production tubing from the cable port and the electrical power cable held therein.

DESCRIPTION OF THE INVENTION

Figure 7:
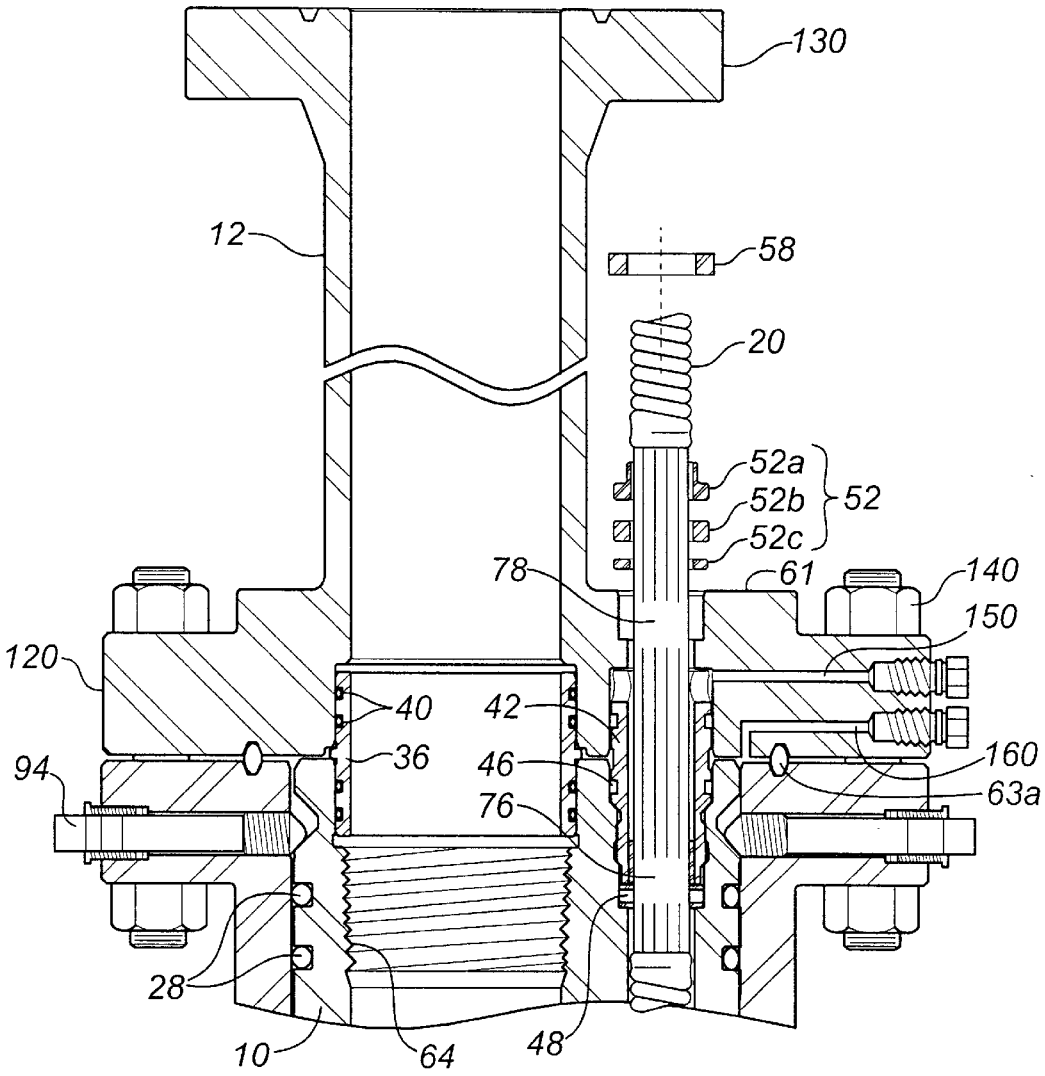
FIG. 7 is a cross-sectional view of the tubing hanger member, tubing head adapter, and electrical power cable (shown in perspective), particularly showing the detail of the tubing head adapter and the position of the O-ring seals on the outer diameter of the tubing hanger member, the O-ring seals of the tubing seal-off nipple, the O-ring seals of the cable seal-off nipple, and the hanger packing set.
Figure 9:
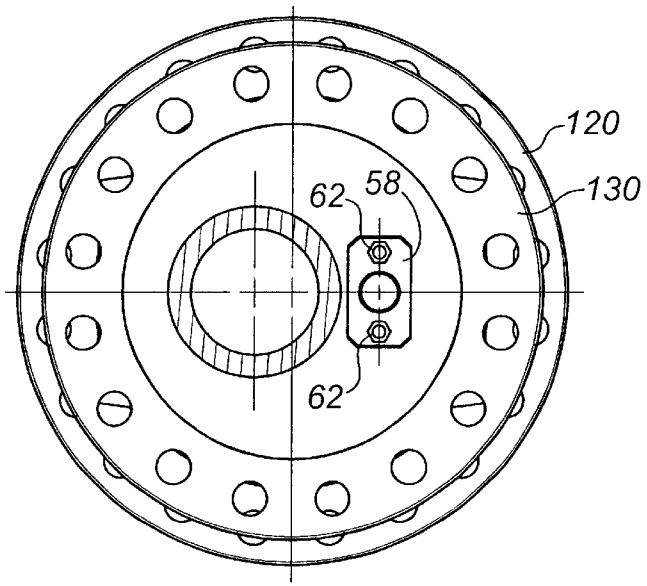
FIG. 9 is a top view of the tubing head adapter taken along line 9—9 of FIG. 8, showing the detail of the bolting and rectangular packing plate over the cable port.
Figure 8:
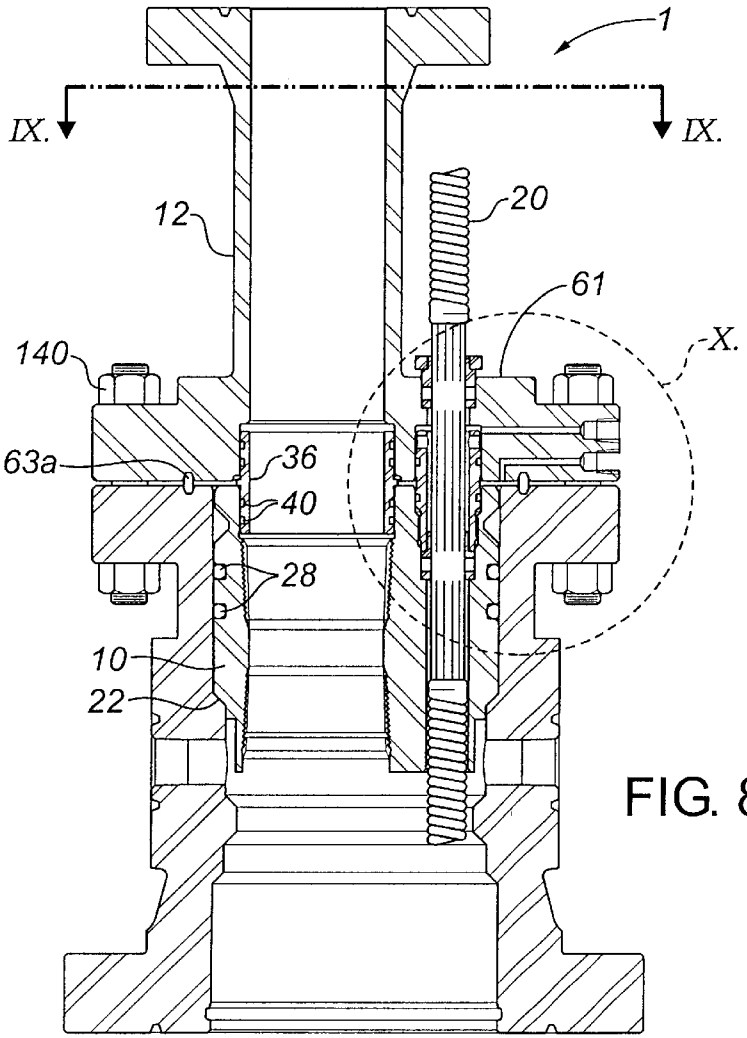
FIG. 8 is a cross-sectional view of the tubing hanger member, tubing head adapter and electrical power cable assembled.
Figure 10:
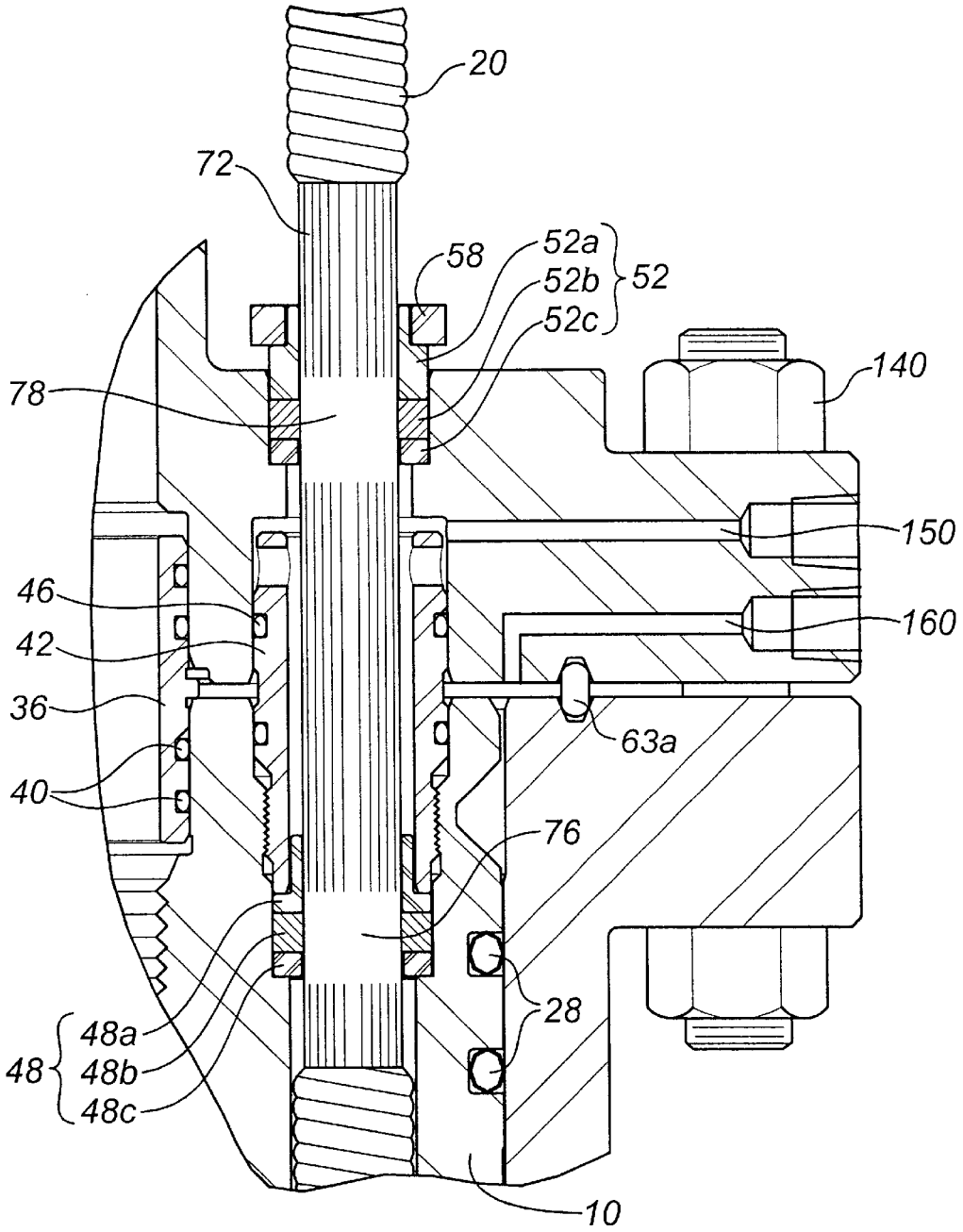
FIG. 10 is an enlarged view of a partially cut away section shown in the circle in FIG. 8, indicating the detail of the cable test ports and hanger test ports.

The invention is described with reference to the drawings in which like parts are labelled with the same numbers in FIGS. 1 to 10. Certain parts which are mentioned may be absent in particular Figures, due to the view of the drawing or obstruction by other parts. Simply for ease of description, FIGS. 1–7 show the tubing hanger assembly 1 in progressive assembly, while FIGS. 8–10 show the tubing hanger assembly 1 fully assembled.

Figure 1:
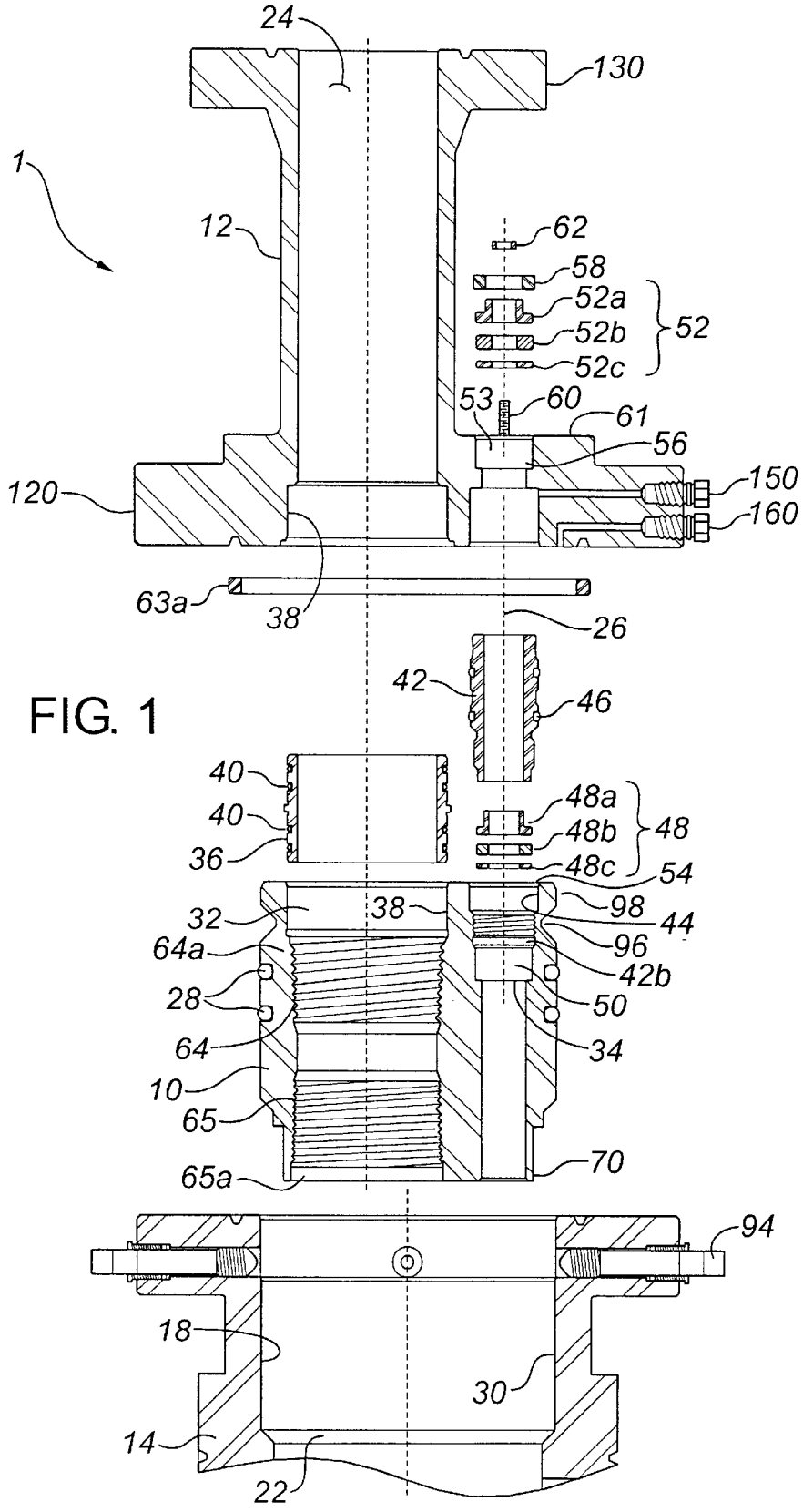
FIG. 1 is a cross-sectional view of the tubing hanger member, tubing head adapter, and tubing head with the relevant components shown unassembled.

The tubing hanger assembly is shown generally at 1 in FIG. 1 to include a tubing hanger member 10 and a tubing head adapter 12 for use in a tubing head 14 of a production well. The tubing hanger assembly 1 provides for passage of production fluids from production tubing 16 mounted therebelow, through a central bore 18 in the tubing head 14 and through the tubing hanger assembly 1, while also providing isolation of the production tubing 16 from an electrical power cable 20 passing through the tubing hanger assembly 1. The tubing hanger member 10 is generally cylindrical and is adapted to seat in a landing seat 22 in the tubing head 14 and to seal against the central bore 18. The tubing head member is shown in FIG. 8 in the seated position to be at least partially and preferably fully, enclosed within the central bore 18. The tubing head adapter 12 is fastened above the tubing head 14 so as to enclose the tubing hanger member 10 in a sealed relationship therebetween (i.e., between the tubing head adapter 12 and the tubing head 14).

The tubing hanger member 10 and the tubing head adapter 12, when assembled, form two aligned, parallel spaced ports extending therethrough (i.e., through both the tubing hanger member 10 and the tubing head adapter 12) to provide a tubing port 24 and a cable port 26. The tubing port 24 connects to the production tubing 16 and permits passage of production fluids, while the cable port 26 enables passing of an electrical power cable 20.

The tubing hanger assembly 1 further includes multiple seals to seal the tubing hanger member 10 within the central bore 18, and to isolate the cable port 26 from (and thus the electrical power cable 20) the generally high pressures encountered in the tubing port 24. The tubing hanger member 10 itself seals to the central bore 18. This is preferably accomplished with at least one and preferably two O-ring seals 28 on its outer diameter which seal against the inner wall 30 of the central bore 18 of the tubing head 14. The tubing hanger member 10 preferably forms a seat 32 in the tubing port 24 and a seat 34 in the cable port 26. The assembly 1, also includes a cylindrical, tubing seal-off nipple 36, which is adapted to connect and seal in the inner wall 38 of the tubing port 24 in both the tubing hanger member 10 and tubing head adapter 12, preferably being seated against seat 32. When assembled, the tubing seal-off nipple 36 is held in the tubing port 24 partially within each of the tubing head adapter 12 and the tubing hanger member 10 (as best seen in FIGS. 7 and 8). The tubing seal-off nipple 36 has at least two, but preferably four seals 40, preferably O-ring seals on its outer diameter, at least one of which seals against the inner wall 38 of the tubing port 24 in the tubing head adapter 12, and at least one of which seals against the inner wall 38 of the tubing port 24 in the tubing hanger member 10.

The assembly 1 also includes a cylindrical cable seal-off nipple 42, which is adapted to seat against the seat 34 in the cable port 26, and to seal against the inner wall 44 of the cable port 26. When assembled, the cable seal-off nipple 42 is held in the cable port 26 partially within each of the tubing head adapter 12 and the tubing hanger member 10 (as best seen in FIGS. 7 and 8). The cable seal-off nipple 42 has at least two O-ring seals 46 on its outer diameter, at least one of which seals against the inner wall 44 of the cable port 26 in the tubing head adapter 12, and at least one of which seals against the inner wall 44 of the cable port 26 in the tubing hanger member 10.

Compressive packing seals are provided above and below the cable seal-off nipple 42 for sealing the electrical power cable 20 in the cable port 26 in both the tubing hanger member 10 and the tubing head adapter 12. To seal below the cable seal-off nipple 42, a hanger packing set 48 is provided, which includes a half-ring bottom segment 48*a*, a half-ring packing segment 48*b*, and a half-ring top segment 48*c*. The tubing hanger member 10 forms a first seal pocket 50 above the seat 34, having an enlarged diameter relative to the inside diameter of the seat 34 (i.e., relative to the opening in the seat 34). The hanger packing set is loaded into the first seal pocket 50, and is compressed by the cable seal-off nipple 42 so as to seal the electrical power cable 20 within the first seal pocket 50 when downwardly energized.

To seal above the cable seal-off nipple 42, an adapter packing set 52 is provided, which includes a half-ring bottom segment 52*a*, a half-ring packing segment 52*b* and a half-ring top segment 52*c*. The tubing head adapter 12 forms a packing seat 53 at the upper end 54 of the cable port 26, on which to seat the adapter packing set 52. The tubing head adapter 12 forms a second seal pocket 56 above the packing seat 53, having an enlarged diameter relative to the inside diameter (i.e., opening of) the packing seat 53. The adapter packing set 52 is loaded into the second seat pocket 56, and is compressed so as to seal the electrical power cable 20 within the second seal pocket 56 when downwardly energized. To close off the upper end 54 of the cable port 26, a rectangular packing plate with a hole is positioned over the electrical power cable 20, and is bolted in place with threaded studs 60 protruding from the top face 61 of the tubing head adapter 12 and nuts 62. Tightening of the nuts 62 against the packing plate 58 compresses and energizes the packing sets 52 and 48 around the electrical power cable 20 so as to seal the power cable 20 in the seal pocket 56 and against the cable port 26.

The first seal pocket 50, with the seat 34, and the hanger packing set 48 together provide a first sealing means below the cable seal-off nipple 42, which when downwardly energized, compresses to form a seal between the electrical power cable 20 and the cable port 26 in the tubing hanger member 10. The second seal pocket 56, with the packing set 53, and the adapter packing set 52 together provide a second sealing means above the cable seal-off nipple 42, which when downwardly energized, compresses to form a seal between the electrical power cable 20 and the cable port 26 in the tubing head adapter 12. Other compressive sealing means may be substituted, as are well known to persons skilled in the art.

As best shown in FIGS. 1 and 7, the tubing head 14 and the tubing head adapter 12 are sealed when fastened together. An exemplary seal is formed with aligned circular grooves 63 in the mating surfaces of the tubing head 14 and the tubing head adapter 12, adapted to receive a ring gasket 63*a*, so as to seal together the tubing head adapter 12 to the tubing head 14.

The tubing port 24 of the tubing hanger member 10 is formed with upper and lower female tubing or casing threads 64, 65 at its upper and lower ends 64*a* and 65*b* respectively. The seat 32 is formed to be upwardly facing as a deep counterbore at the upper end 64*a* of the casing threads 64 to engage and seat the tubing seal-off nipple 36. While the lower threads 65 are provided to connect production tubing 16, the upper threads 64 are provided for landing the tubing hanger member 10, as described below.

Figure 2:
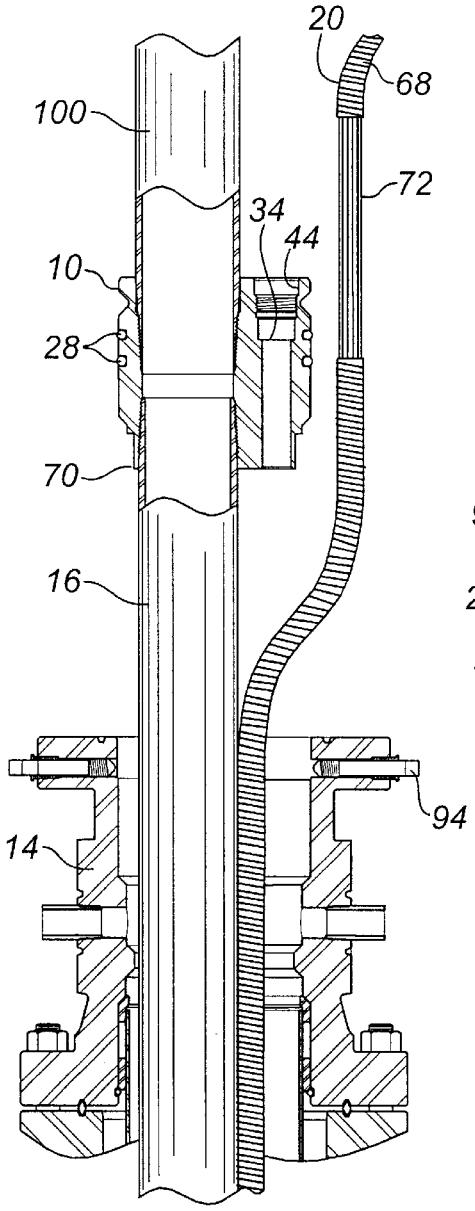
FIG. 2 is a cross-sectional view of the tubing hanger, production tubing, and the tubing head (prior to seating the tubing hanger member therein), showing the electrical power cable in perspective prior to its installation.
Figure 3:
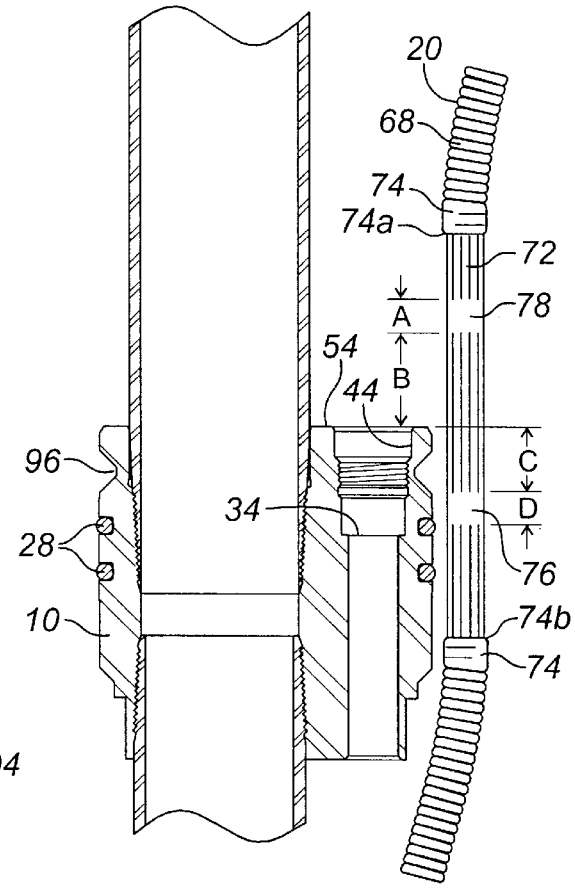
FIG. 3 is an enlarged view of a tubing hanger member of FIG. 2, showing the detail of the exposed areas of the electrical power cable (again in perspective) in preparation for feeding through the cable port of the tubing hanger member.

FIGS. 2 and 3 illustrate the preparation of the electrical power cable 20 before it is fed through the cable port 26 in the tubing hanger member 10. FIG. 2 is a cross-sectional view of the tubing hanger member 10, production tubing 16, tubing head 14, and electrical power cable 20 prior to installation. The electrical power cable 20 typically is provided with armour sheathing 68, and is coiled or bowed during installation such that it maintains flexibility. The electrical power cable 20 is of sufficient length to reach the electrical junction for the power supply (not shown). For example, 10 ft of non-strapped electrical power cable 20 may be left below the lower end 70 of the tubing hanger member 10. During installation, the electrical power cable 20 is held straight tip against the production tubing 16 about 18" below the lower end 70 of the tubing hanger member 10, then over and adjacent to the cable port 26 in the tubing hanger member 10, as shown in FIG. 2.

FIG. 3 is an enlarged view of a partially cut away section of the tubing hanger member 10 and the electrical power cable 20 as shown in FIG. 2, showing exposed area 72 of the electrical power cable 20 after its armour sheathing 68 has been removed. Stripping the sheathing 68 for about 12" exposes the underlying splined black jacket (i.e., exposed area 72) in the area where the electrical power cable 20 passes through the zones of the cable port 26 of tubing hanger member 10, the cable seal-off nipple 42, the hanger packing set 48, and the adapter packing set 52 (not illustrated in FIG. 3). The exposed area 72 might be, for example, 12" in length. Tape 74 is preferably used to cover the sharp ends of the armour 68 at the upper and lower ends 74*a*, 74*b* of the exposed area 72, with the tape 74 preferably having a diameter so as not to restrict passage of the electrical power cable 20 in the cable port 26. Within the exposed area 72 of the splined black jacket, splines of the exposed splined black jacket 72 are preferably removed, for example using an emery cloth, to expose a first sealing area 76 and a second sealing area 78 for alignment with the hanger packing set 48 and the adapter packing set 52 respectively. Removing the splines assures tighter seals with the power cable 20 when assembled.

Figure 4:
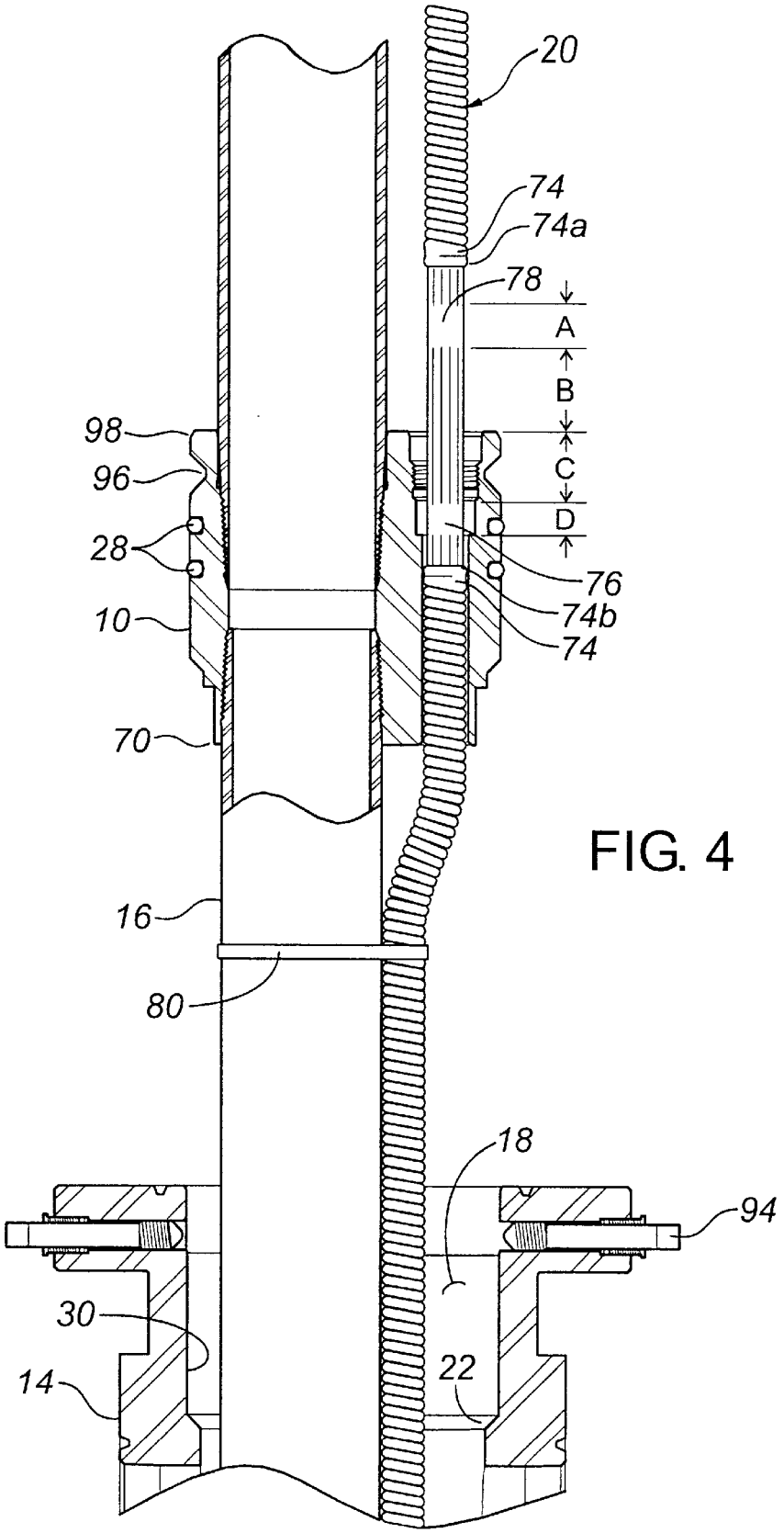
FIG. 4 is cross-sectional view of the tubing hanger member, production tubing and electrical power cable (shown in perspective), showing the detail of the electrical power cable following installation.

FIG. 4 is a cross-sectional view of the tubing hanger member 10, production tubing 16 and electrical power cable 20, showing the detail of the electrical power cable 20 following preparation and installation. The electrical power cable 20 is threaded through the cable port 26 and is positioned such that the first sealing area 76 and the second sealing area 78 are in place. During installation, measurements are made from the top face of the tubing hanger member 10 to sections A, B, C and D with the electrical power cable 20 taut. Exemplary dimensions follow. Section A represents the cable packoff area in the tubing head adapter 12 and has a length of about 2" to seal with the adapter packing set 52. Section B represents the distance to the cable packing area and has a length of about 3". Section C represents the distance to the cable packing area and has a length of about 2". Section D represents the cable packoff area to seal with the hanger packing set 48 in the tubing hanger member 10 and has a length of about 2". A strap 80 is used to strap the electrical power cable 20 to the production tubing 16.

Figure 5:
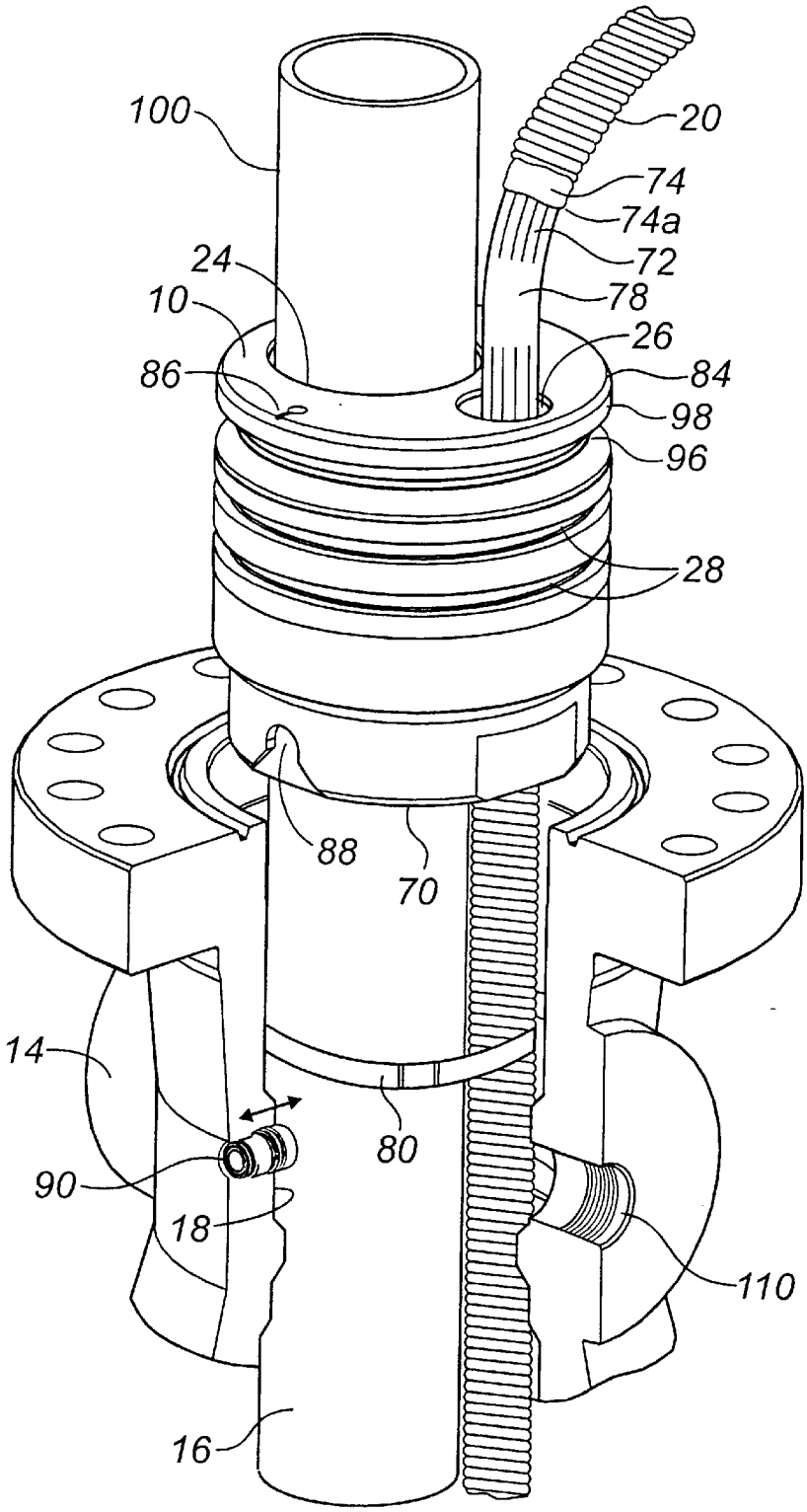
FIG. 5 is a partial cross-sectional, partial perspective view of the tubing hanger member, tubing head, electrical power cable and positioning means for landing the tubing hanger member into the tubing head during installation.

FIG. 5 is a partial cross-sectional partial perspective view of the tubing hanger member 10, tubing head 14, and electrical power cable 20 to show a means for positioning the tubing hanger member 10 into the tubing head 14 during landing installation. The top face 84 of the tubing hanger member 10 has an aligning notch 86 which is positioned above the location of an aligning slot 88 on the outer diameter of the lower end 70 of the tubing hanger member 10. An aligning screw 90 is provided in the tubing head 14 to protrude into the central bore 18 and to engage the aligning slot 88. The aligning slot 88 of the tubing hanger member 10 fits over the aligning screw 90 in the tubing head 14. Lockscrews 94 secure the tubing hanger member 10 into the tubing head 14 (see FIGS. 1 and 6) by engaging in locking recess 96 at the upper end 98 of the tubing hanger member 10. During installation, a landing joint 100 is threaded into the tubing port 24 with upper threads 64 to land the tubing hanger member 10 into the tubing head 14. The landing joint 100 is removed along with the aligning screw 90 from the tubing head 14, following landing of the tubing hanger member 10 into the tubing head 14. An outlet 110 (one of two outlets) to allow testing of annulus pressure is illustrated in FIG. 5, but is not pertinent to the design of the tubing hanger assembly 1 of this invention.

Figure 6:
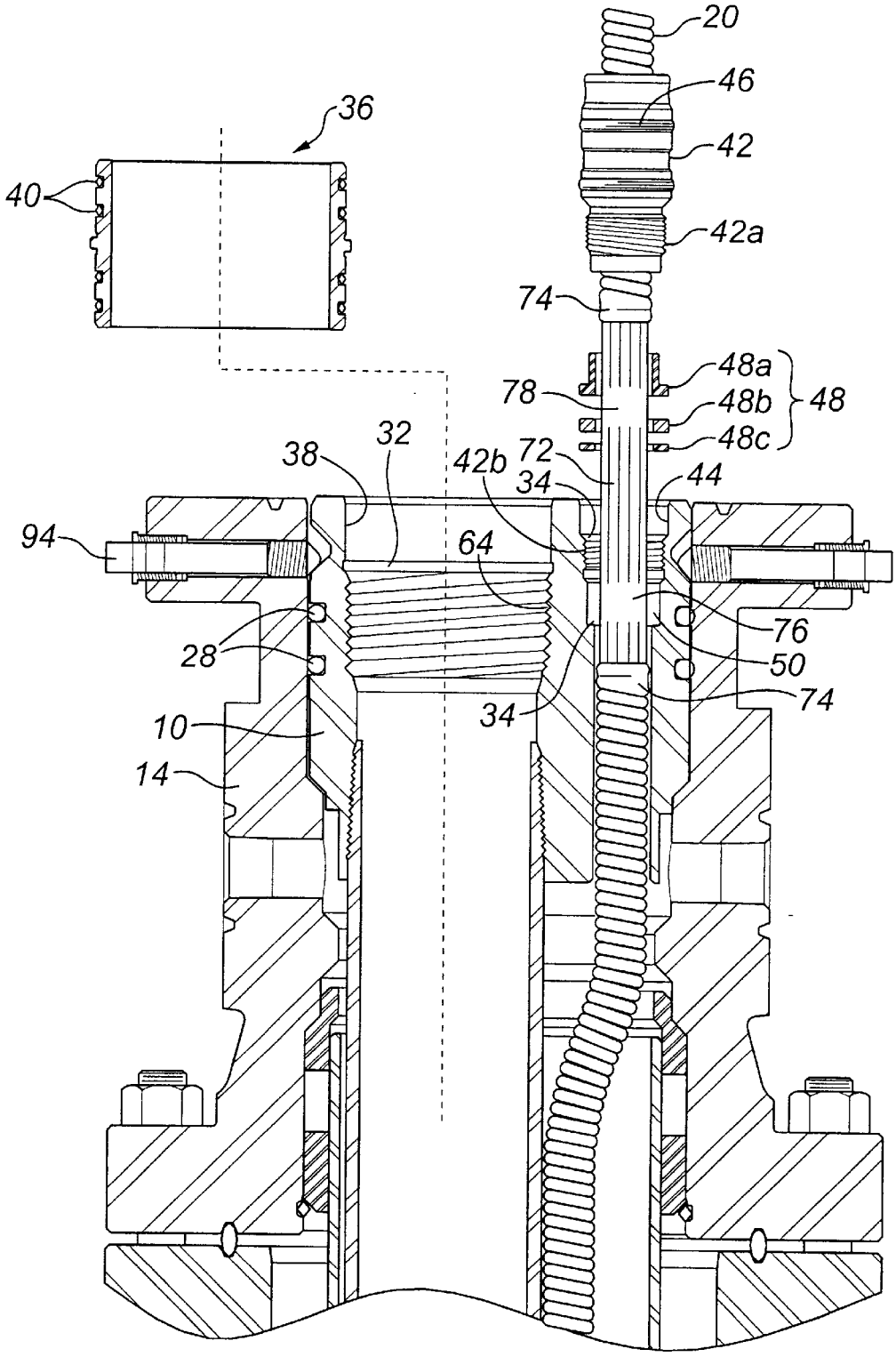
FIG. 6 is a cross-sectional view of the tubing hanger member and electrical power cable (shown in perspective), showing the installation of the tubing seal-off nipple (production side) and the cable seal-off nipple (cable side) and the detail of the hanger packing set.

FIG. 6 is a cross-sectional view of the tubing hanger member 10 and the electrical power cable 20, showing the installation of the tubing seal-off nipple 36 and cable seal-off nipple 42. The hanger packing set 48 preferably includes the half-ring bottom segment 48*a*, the half-ring packing segment 48*b*, and the half-ring top segment 48*c*. The hanger packing set 48 is selected for scaling, based upon the size and type of the electrical power cable 20 and the diameter of the first 76 and second 78 seal areas to seal within the first seal pocket 50. The hanger packing set 48 is shown as being seated into the first seal pocket 50.

During installation, the cable seal-off nipple 42 is positioned over the electrical power cable 20 and is pressed down to the cable port 26 of the tubing hanger member 10, to contact and energize the hanger packing set 48. The cable seal-off nipple 42 is preferably threaded at its lower end 42*a*. The cable port 26 is similarly formed with mating threads 42*b* above the first seal pocket 50. The cable seal-off nipple 42 is thus threaded into the cable port 26 to contact and energize the hanger packing set 48. The tubing seal-off nipple 36 is shown as being seated against the seat 32 in the tubing port 24.

FIG. 7 is a cross-sectional view of the tubing hanger member 10, tubing head adapter 12, and electrical power cable 20, particularly showing sealing details, and the installed positions of the seal-off nipples 36, 42. The tubing hanger member is generally flush with the top of the tubing head 14. The seal-off nipples 36, 42 straddle the tubing head adapter 12 and the tubing head 14, with the O-ring seals 40, 46 of the seal-off nipples 36, 42 being positioned to seal against the ports 24, 26 in both of the tubing head adapter 12 and the tubing head 14. The O-ring seals 28 on the outer diameter of the tubing hanger member 10 seal against the inner wall 30 of the central bore 18 of the tubing head 14. The O-ring seals 40 of the tubing seal-off nipple 34 seal against the inner wall 38 of the tubing port 24 against both the tubing head adapter 12 and in the tubing hanger member 10. The O-ring seals 46 of the cable seal-off nipple 42 seal against the inner wall 44 of the cable port 26 against both the tubing head adapter 12 and in the tubing hanger member 10. The hanger packing set 48 seals the electrical power cable 20 below the cable seal-off nipple 42, in the first seal pocket 50. The adapter packing set 52 seals the electrical power cable 20 above the cable seal-off nipple 42 in second seal pocket 56. The ring gasket 63*a* seals the tubing head adapter 12 to the tubing head 14, and encloses the tubing hanger member 10 therebetween.

The tubing head adapter 12 has bottom flanges 120 and top flanges 130. The bottom flange 120 is fastened with bolts 140 to the tubing head 14, while the top flange 130 is bolted to a Christmas tree (not shown). The adapter packing set 52 is selected based upon the size and type of the electrical power cable 20, and the diameter of the first 76 and second 78 seal areas to seal within the second seal pocket 56. The adapter packing set 52 is shown being seated within the second seal pocket 56 in the tubing head adapter 12. The ring gasket 63*a* is shown installed in the circular grooves 63 of the tubing hanger member 10.

FIG. 8 is a cross-sectional view of the tubing hanger member 10, tubing head adapter 12 and electrical power cable 20 assembled. FIG. 9 is a top view of the tubing head adapter 12, showing the detail of the rectangular packing plate 58 bolted over the cable port 26 (hidden from view).

During the last stage of installation, the rectangular packing plate 58 from the top of the tubing head adapter 12 is attached. The electrical power cable 20 is fed through the cable port 26 in the tubing head adapter 12. The tubing head adapter 12 and Christmas tree (not shown) are positioned over the tubing head 14 to line up the tubing seal-off nipple 36 and cable seal-off nipple 42 with their respective seats 32 and 34. The rectangular packing plate 58 is run over the electrical power cable 20 and down onto the studs 60 protruding from the top face of the tubing head adapter 12. The rectangular packing plate 58 is secured via the bolts 62 evenly on both sides. The rectangular packing plate 58, in position above the adapter packing set 52, thus compresses and energizes the adapter packing set 52 around the electrical power cable 20.

The tubing head adapter 12 preferably provides a cable test port 150 and a hanger test port 160 as shown in FIG. 10. The cable test port 150 extends through the tubing head adapter 12 to communicate with the first and second seal pockets 50, 56 within the cable port 26. The cable test port 150 can be accessed from the outside of the tubing head adapter 12 without having to disassemble any of the components. A pressure test may be performed to verify the integrity of the cable port seals. The cable test port 150 allows pressure testing of the seals provided by the adapter packing set 52 (which seals the cable port 26 above the cable seal-off nipple 42 against the electrical power cable 20) and the hanger packing set 48 (which seals the cable port 26 below the cable seal-off nipple 42 against the electrical power cable 20). All seals on the cable side are typically rated at pressures of 500 psi.

The hanger test port 160 extends through the tubing head adapter 12 to the tubing seal-off nipple 36 in the tubing port 24. The hanger test port 160 can be accessed from the outside of the tubing head adapter 12 without having to disassemble any of the components. A pressure test may be performed to verify the integrity of the seals on the production tubing side. The hanger test port 160 allows pressure testing of the O-ring seals 28 on the outer diameter of the tubing hanger member 10 (which seals against the inner wall 30 of the central bore 18 in the tubing head 14); the O-ring seals 40 on the outer diameter of the tubing seal-off nipple 36 (which seal against the inner wall 38 of the tubing port 24 against the tubing head adapter 12 and the tubing hanger member 10); and the ring gasket 63*a* (which seals the tubing head adapter 12 to the tubing head 14 and secures the tubing member 10 therebetween.

The O-ring seals 46 of the cable seal-off nipple 42 isolate the cable and hanger test ports 150, 160 so as to further isolate the cable port 26 from the higher pressures encountered in the tubing port 24 (typically greater than 2000 psi).

It is possible to modify the tubing hanger assembly of this invention to include multiple cable ports to accommodate multiple power cables, in which case appropriate parts set out above are duplicated. Extra cable ports may be capped off when not in use. Any dimensions given in this description are exemplary only and may be modified as is well know in the art.

The terms and expressions used are, unless otherwise defined herein, used as terms of description and not limitation. There is no intention, in using such terms and expressions, of excluding equivalents of the features illustrated and described.

We claim:

1. A tubing hanger assembly for use in a tubing head of a production well, and which provides for passage of production fluids from the production tubing mounted therebelow, through a central bore in the tubing head and through the tubing hanger assembly, while also providing isolation of the production tubing from an electrical power cable which passes through the tubing hanger assembly, said tubing hanger assembly comprising:

a generally cylindrical tubing hanger member adapted to seat in a landing seat in the tubing head, and to seal against the central bore;

a tubing head adapter adapted to be fastened above the tubing head so as to enclose the tubing hanger member in a sealed relationship therebetween;

the tubing head adapter and the tubing hanger member together forming two aligned, parallel spaced ports extending therethrough to provide a tubing port, which connects to the production tubing and permits passage of production fluids, and a cable port through which the electrical power cable extends;

the tubing hanger member forming a seat in the cable port;

a cylindrical tubing seal-off nipple adapted to connect and seal the tubing port in each of the tubing head adapter and the tubing hanger member;

a cylindrical cable seal-off nipple adapted to seat against the seat in the cable port, and to connect and seal the cable port in each of the tubing head adapter and the tubing hanger member;

a first seal below the cable seal-off nipple for sealing between the electrical power cable and the cable port in the tubing hanger member;

a second seal above the cable seal-off nipple for sealing between the electrical power cable and the cable port in the tubing head adapter;

whereby, the tubing seal-off nipple and the cable seal-off nipple when sealed in the tubing and cable ports, provide isolation of the production tubing from the cable port and the electrical power cable held therein.

2. The tubing hanger assembly according to claim 1, wherein the tubing hanger member forms a first seal pocket above the seat in the cable port, having an enlarged diameter relative to the inside diameter of the seat, and wherein the first seal seals within the first seal pocket.

3. The tubing hanger assembly according to claim 2, wherein the first seal comprises a hanger packing set adapted to be compressed in the first seal pocket between the cable seal-off nipple and the seat in the cable port so as to seal within the first seal pocket.

4. The tubing hanger assembly according to claim 3, wherein the tubing head adapter forms a packing seat in the cable port above the cable seal-off nipple, and a second seal pocket above the packing seat, the second seal pocket having an enlarged diameter relative to the inside diameter of the packing seat, and wherein the second seal seals within the second seal pocket.

5. The tubing hanger assembly according to claim 4, wherein the second seal comprises an adapter packing set and a rectangular packing plate, sized to bolt over and cover the cable port and being formed with a hole sized to allow the electrical power cable to pass therethrough, wherein the adapter packing set is adapted to be compressed in the second seal pocket between the rectangular plate and the packing seat in the cable port so as to seal within the second seal pocket.

6. The tubing hanger assembly according to claim 5, wherein the cable seal-off nipple has at least two seals, at least one to seal against the inner wall of the cable port in the tubing head adapter and at least one to seal against the inner wall of the cable port in the tubing hanger member.

7. The tubing hanger assembly according to claim 6, wherein the tubing seal-off nipple has at least two seals, at least one to seal against the inner wall of the tubing port in the tubing head adapter and at least one to seal against the inner wall of the tubing port in the tubing hank member.

8. The tubing hanger assembly according to claim 7, wherein the tubing head adapter is formed with a cable test port communicating to the first and second sealing pockets to allow pressure testing of the first and second seals in the cable port after assembly of the tubing hanger assembly.

9. The tubing hanger assembly according to claim 8, wherein the tubing head adapter is formed with a hanger test port communicating to the tubing seal-off nipple in the tubing port to allow pressure testing of the seal between the tubing seal-off nipple and the inner all of the tubing port after assembly of the tubing hanger assembly.

10. The tubing hanger assembly according to claim 9, wherein the hanger test port also communicates to the seal between the tubing head and the tubing head adapter, and to the seal between the tubing hanger member and the central bore of the tubing head to allow pressure testing of these seals.

11. The tubing hanger assembly according to claim 10, wherein the seals of the cable seal-off nipple to the cable port isolate the first and second seals from the hanger test port.

12. The tubing hanger assembly, according to claim 11, wherein the tubing hanger adapter and the tubing hanger member together form a plurality of aligned, parallel spaced cable ports to accommodate a plurality of electrical power cables, and wherein the tubing hanger assembly further comprises multiple cable seal-off nipples and seals according to the previous claims as needed to accommodate the plurality of electrical power cables, or a cap plate to cap off any unused cable ports.

13. The tubing hanger assembly according to claim 1, wherein the tubing head adapter is formed with a cable test port communicating to the first and second seals to allow pressure testing of the first and second seals in the cable port after assembly of the tubing hanger assembly.

14. The tubing hanger assembly according to claim 1, wherein the tubing head adapter is formed with a hanger test port communicating to the tubing seal-off nipple in the tubing port to allow pressure testing of the seal between the tubing seal-off nipple and the tubing port after assembly of the tubing hanger assembly.

* * * * *